US010456701B2

(12) United States Patent
Healy et al.

(10) Patent No.: US 10,456,701 B2
(45) Date of Patent: Oct. 29, 2019

(54) INFANT ACTIVITY CENTER

(71) Applicant: Skip Hop, Inc., New York, NY (US)

(72) Inventors: John Healy, Brooklyn, NY (US); Benjamin Bearsch, Brooklyn, NY (US); Janet Villano, Jersey City, NJ (US); Ellen Diamant, New York, NY (US)

(73) Assignee: SKIP HOP, INC., New York, NY (US)

( * ) Notice: Subject to any disclaimer, the term of this patent is extended or adjusted under 35 U.S.C. 154(b) by 0 days.

(21) Appl. No.: 15/429,855

(22) Filed: Feb. 10, 2017

(65) Prior Publication Data

US 2017/0232355 A1 Aug. 17, 2017

Related U.S. Application Data

(60) Provisional application No. 62/300,439, filed on Feb. 26, 2016, provisional application No. 62/294,532, filed on Feb. 12, 2016.

(51) Int. Cl.

| | |
|---|---|
| ***A63H 33/00*** | (2006.01) |
| ***A47D 3/00*** | (2006.01) |
| ***A47D 1/00*** | (2006.01) |

(52) U.S. Cl.

CPC ..... *A63H 33/006* (2013.01); *A47D 1/008* (2013.01); *A47D 3/001* (2017.05)

(58) Field of Classification Search

CPC ..... A63H 33/00; A63H 33/006; A47D 1/00; A47D 1/008; A47D 15/00; A47D 13/043; A47D 13/107; A47D 13/00

See application file for complete search history.

(56) References Cited

U.S. PATENT DOCUMENTS 1,279,615 A * 9/1918 Van Meter ..... A63H 33/006 446/227
4,927,024 A * 5/1990 Lloyd ..... A47G 19/10 206/562

(Continued)

FOREIGN PATENT DOCUMENTS

CA 2774860 A1 * 10/2013 ..... A63H 33/006
CA 2774860 A1 * 10/2013 ..... A63H 33/006

(Continued)

OTHER PUBLICATIONS

European Search Report dated Oct. 26, 2017 in corresponding European Application No. 17 15 5622.

(Continued)

*Primary Examiner* — Eugene L Kim
*Assistant Examiner* — Alyssa M Hylinski
(74) *Attorney, Agent, or Firm* — Stephen J. Weyer, Esq.; James R. Hayne, Esq.; Stites & Harbison, PLLC

(57) ABSTRACT

A child activity center includes a tabletop having a top play surface and a bottom surface opposite the top play surface, and a central opening. A plurality of legs, are attached to tabletop and a lower platform is attached to the legs by a plurality of straps that are connected to the platform. A child seat is advantageously removably attached to the tabletop via over the central opening, in one form. Optional unique clips attach toys to the tabletop and one or more optional openings or windows in the tabletop allow an infant to see through the tabletop to the observe objects therebelow.

29 Claims, 15 Drawing Sheets

(56) References Cited

U.S. PATENT DOCUMENTS

| | | | | |
|---|---|---|---|---|
| 5,518,475 | A * | 5/1996 | Garland | A47D 13/043 482/66 |
| 5,603,479 | A * | 2/1997 | Kristy | F16M 11/40 248/104 |
| 5,728,030 | A * | 3/1998 | Hsieh | A47D 13/043 472/15 |
| 7,182,993 | B1 * | 2/2007 | Hamilton | A47B 95/043 108/27 |
| 10,342,361 | B2 * | 7/2019 | Cotirla | A47D 13/107 |
| 2003/0184036 | A1 * | 10/2003 | Wu | A47D 13/043 280/87.051 |
| 2004/0048547 | A1 * | 3/2004 | Gubitosi | A63H 5/00 446/173 |
| 2005/0264088 | A1 * | 12/2005 | Tadin | A47D 3/00 297/488 |
| 2009/0200841 | A1 * | 8/2009 | Rhoten | A47D 1/00 297/157.1 |
| 2010/0231015 | A1 * | 9/2010 | Lundeen | A47D 3/00 297/217.1 |
| 2011/0012408 | A1 | 1/2011 | Lee et al. | |
| 2013/0319884 | A1 * | 12/2013 | Gomez | F16M 13/06 206/216 |
| 2014/0174334 | A1 * | 6/2014 | Tucker | G09F 17/00 116/173 |
| 2015/0090162 | A1 * | 4/2015 | Vlosich | A47D 11/00 108/18 |
| 2017/0368465 | A1 * | 12/2017 | Brown | A63H 33/006 |

FOREIGN PATENT DOCUMENTS

| | | | |
|---|---|---|---|
| CN | 105 231 725 | 1/2016 | |
| CN | 205 144 102 | 4/2016 | |
| CN | 205 144 104 | 4/2016 | |
| CN | 205 144 108 | 4/2016 | |
| DE | 20109602 U1 * | 9/2001 | A47B 13/088 |
| DE | 20109602 U1 * | 9/2001 | A47B 13/088 |

OTHER PUBLICATIONS

European Search Report dated Dec. 11, 2018 in corresponding European Application No. 17 155 622.8.

* cited by examiner

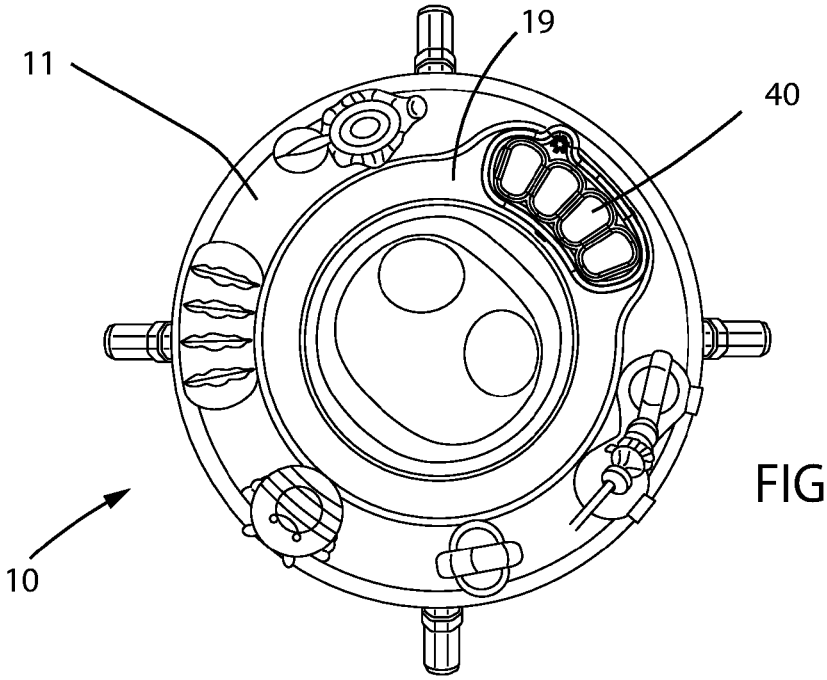
FIGURE 4a
FIGURE 4b
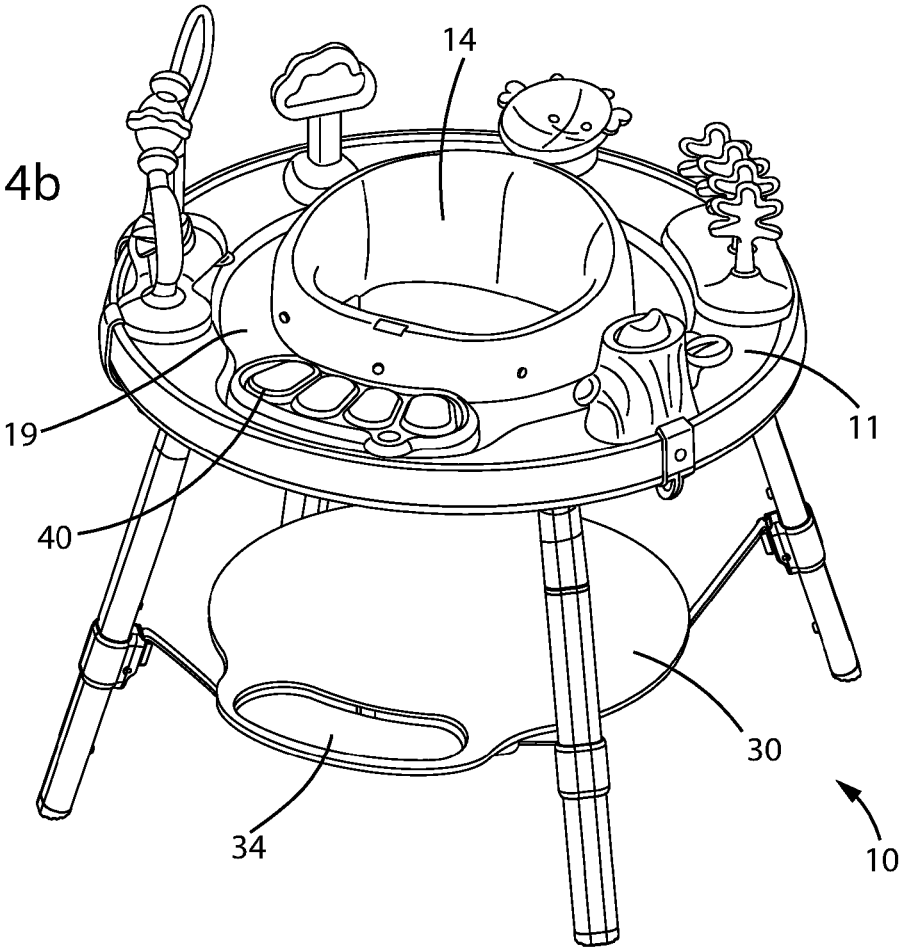

INFANT ACTIVITY CENTER

CROSS-REFERENCE TO RELATED APPLICATION

This application claims the benefit of U.S. Provisional Application No. 62/294,532, filed Feb. 12, 2016, and U.S. Provisional Application 62/300,439, filed Feb. 26, 2016, each of which is incorporated in its entirety.

FIELD OF INVENTION

The present invention relates to an play activity center for an infant and toddler and in particular an activity center with numerous visual, sensory and auditory elements.

BACKGROUND OF THE INVENTION

Infants and toddlers develop physically and mentally by interacting with their environment. In order to present an infant with different stimuli, companies have developed toys, gyms and the like. An activity center is a recently developed product which integrates or combines elements to entertain and educate an infant and toddler.

SUMMARY OF THE INVENTION

The present invention relates to a unique, new activity center which includes numerous innovations over prior known activity centers. The child activity center includes a tabletop having a top play surface and a bottom surface opposite the top play surface, and a central opening. A child seat is removably attached to the tabletop via over the central opening. A plurality of legs, are attached to tabletop and a lower platform is attached to the legs by a plurality of straps that are connected to the platform.

In some embodiments, the child activity center further includes a wheel track surrounding the central opening. The child seat may include an attachment ring configured to removably attach on the top play surface over the central opening of the tabletop to allow the attachment ring to rotate 360 degrees. A plurality of wheels attached to underside of the attachment ring are in contact with the wheel track when the attachment ring is attached to the tabletop. A fabric is attached through an internal opening in the attachment ring and configured to receive a lower portion of a child when the attachment ring is attached to the tabletop. The seat is composed of, or includes elastic material. When an infant is placed in the seat, the elastic material may stretch and retract in response to vertical movement of the child. Alternatively, the child seat may be attached to the tabletop by one or more elastic fabric components.

In some embodiments, one end of the plurality of straps are attachable to a plurality of locations on the legs. Additionally or alternatively, the straps are comprised of an inelastic material.

In some embodiments, the child activity center further includes an interactive toy which responds to a child's movements. The interactive toy may produce sound and/or illuminate based on a child's movements. The child's movements include merely moving his or her arms and legs and may also include physically touching the interactive toy.

In one specific example of an interactive toy which responds to physical interaction, the toy is a button accessory comprised of a plurality of buttons and the button accessory may be removably attachable to the to play surface of the tabletop. Further, in some embodiments, each of the plurality of buttons, when activated, emits a sound. Further still, each of the plurality of buttons may include a light source and, when one of the buttons is activated, the light source of the button is activated.

In some embodiments that include the button accessory, the tabletop further comprises a window hole extending through from the top play surface to the bottom surface of the tabletop. The window hole may be covered by a transparent window. Further, the button accessory may be attachable to the tabletop over the window hole. Additionally or alternatively, the button accessory may be attachable to the top surface of the lower platform, either directly onto the surface or to a recess on the top surface of the lower platform.

In some embodiments, the tabletop may further comprises a rim or lip that extends perpendicular to the top play surface and extends between the top play surface and the bottom surface. The activity center may further include one or more accessories that are removably attachable to the activity center. Advantageously, the accessories are mounted to the tabletop without using through holes. For example, the removably attached accessory can have an accessory end portion facing away from the top play surface and a suction cup facing the play surface, allowing secure placement of the accessory to the top play surface without through holes in the top play surface.

In one further advantageous form, removable accessory comprises a bracket below the accessory end to which the suction cup is attached and the bracket has a bracket extension which removably clips below the rim/skirt of the tabletop. In yet a further form, the bracket extension has a C-shaped hook which engages the rim of the tabletop, below the top play surface.

The mounting bracket of the accessory allows for the top play surface to be devoid of holes and/or openings when the accessories are not attached to the tabletop, while still allowing for the accessories to be secured in place when desired.

In some embodiments, the tabletop includes a recess, and the lower platform is insertable into the recess. The recess is sized to receive the platform when the child activity center is in the second configuration; and wherein the rim play area is devoid of openings and indentations. Alternatively, the tabletop includes a plurality of window holes extending through the tabletop.

In yet another advantageous form, a child activity center includes a tabletop having a top play surface, a central opening, and a window opening in front of the central opening. A child seat is configured to be disposed in central opening of the tabletop. The window opening is of a sufficient size to allow a child seated in the seat to see his or her feet and/or toys located below the tabletop through the window opening. In one further advantageous form, a transparent member in the window opening.

The window opening can have various desired shapes and sizes. In one form, the window opening is a cut-out from a remaining outer periphery edge of the table top. In an alternative form, the window opening is elongated circumferentially around the tabletop.

In another alternative form, the table top has at least one second window opening of sufficient size so that a child, placed in the seat can see his or her feet and/or toys located below the tabletop through the at least one second window opening.

In still a further, alternative form, the activity center has a platform disposed below the tabletop and there is at least one top disposed on the platform. The window opening permits a child placed in the seat to see the toy through the window opening.

BRIEF DESCRIPTION OF THE FIGURES

FIG. 4*a* shows an overhead view of the activity center with the button accessory located on the play tabletop in accordance with the present invention.

FIG. 4*b* shows a perspective view of the activity center with the button accessory located on the play tabletop in accordance with the present invention.

DETAILED DESCRIPTION

Figure 1:
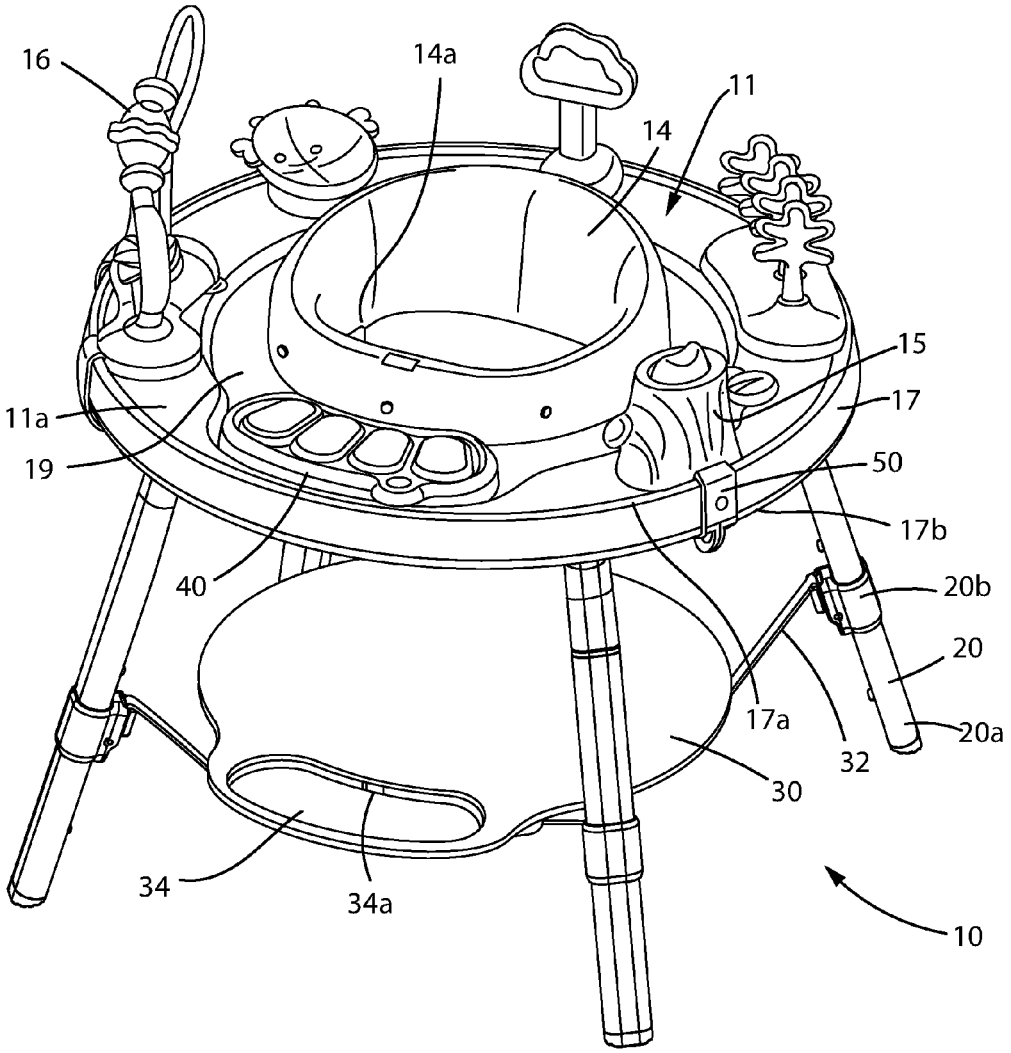
FIG. 1 shows one embodiment of the activity center with a button accessory located on a top play surface.

Referring to FIG. 1, the present invention is directed to a unique activity center 10 for an infant. The activity center 10 includes a tabletop 11 having a central opening 11*b* (see FIG. 7*c*). A child seat 14 is located in the center of the tabletop 11 and the seat 14 can rotate 360 degrees. An upper or top surface of the tabletop 11 acts as a play surface 11*a* for a child seated in the seat 14, which may rotate to allow the child to easily access the entirety of the tabletop 11 and any items attached or placed on the tabletop 11.

A bottom platform 30 is suspended below and substantially parallel to the tabletop 11 of the child activity center by a plurality of straps 32. The bottom platform 30 is positioned at a level that is accessible to the feet of a child seated in the child seat 14. The bottom platform 30 may be adjusted to different distances from the tabletop 11 to allow for infants of different sizes to fit comfortably in the activity center 10 while still allowing the child's feet to come into contact with the bottom platform 30.

A button accessory 40 (shaped to resemble a toy piano) is an interactive toy which responds to a child's movements. The button accessory 40 is attached to the upper surface of the tabletop 11. In some embodiments, the button accessory 40 may attach in alternative places, such as the bottom platform recess 34, as described below. As described herein, the tabletop 11 may include an opening to allow an infant to inspect the button accessory 40 when mounted on the bottom platform 30.

As an alternative to the button accessory 40 which is an interactive toy requiring physical touch, other interactive toys (not shown), include ones which respond to a child's movements without physically touching the interactive toy. Such interactive toys can play sounds, music and/or illuminate, etc. merely based the movement of a child's arms, hand, legs feet, etc., without physically touching the interactive toy.

Figure 2A:
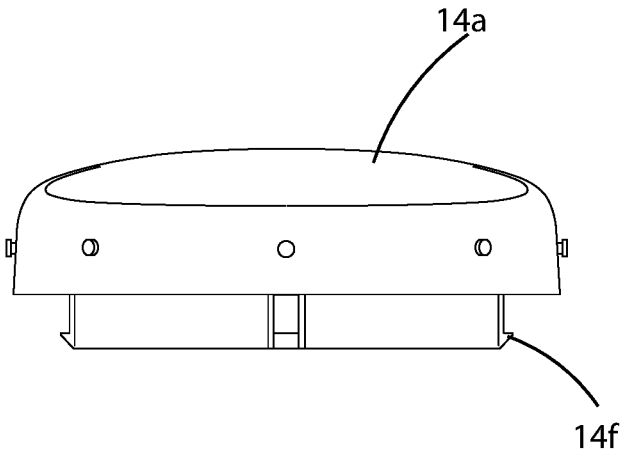
FIG. 2*a* shows a side view of the attachment ring portion of parts of the seat of the activity center in accordance with aspects of the present invention.
Figure 2B:
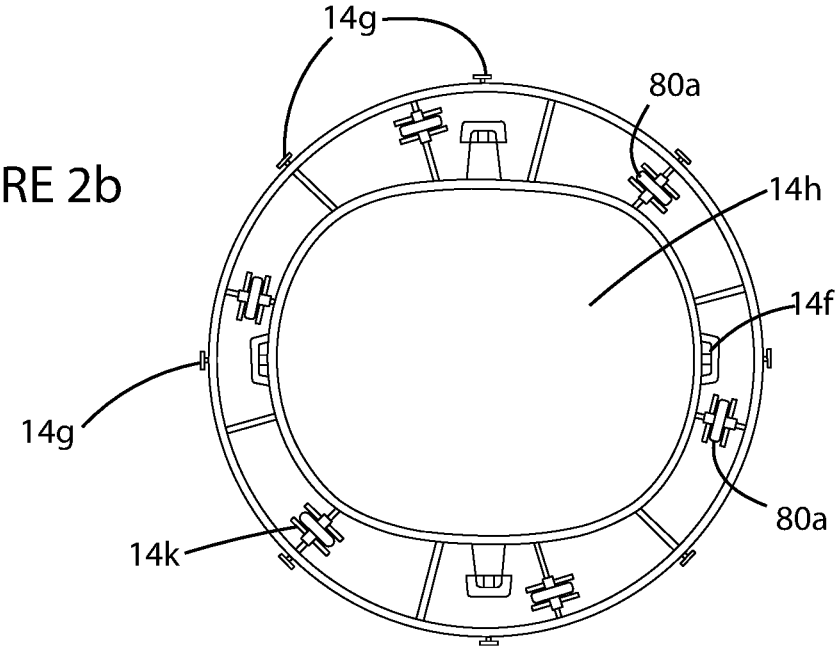
FIG. 2*b* shows a bottom view of the attachment ring portion of parts of the seat of the activity center in accordance with aspects of the present invention.
Figure 2C:
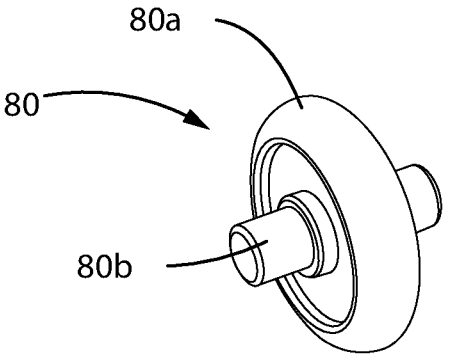
FIG. 2*c* shows a wheel that may be attached to the attachment ring to allow for the attached seat to smoothly rotate 360 degrees.
Figure 2D:
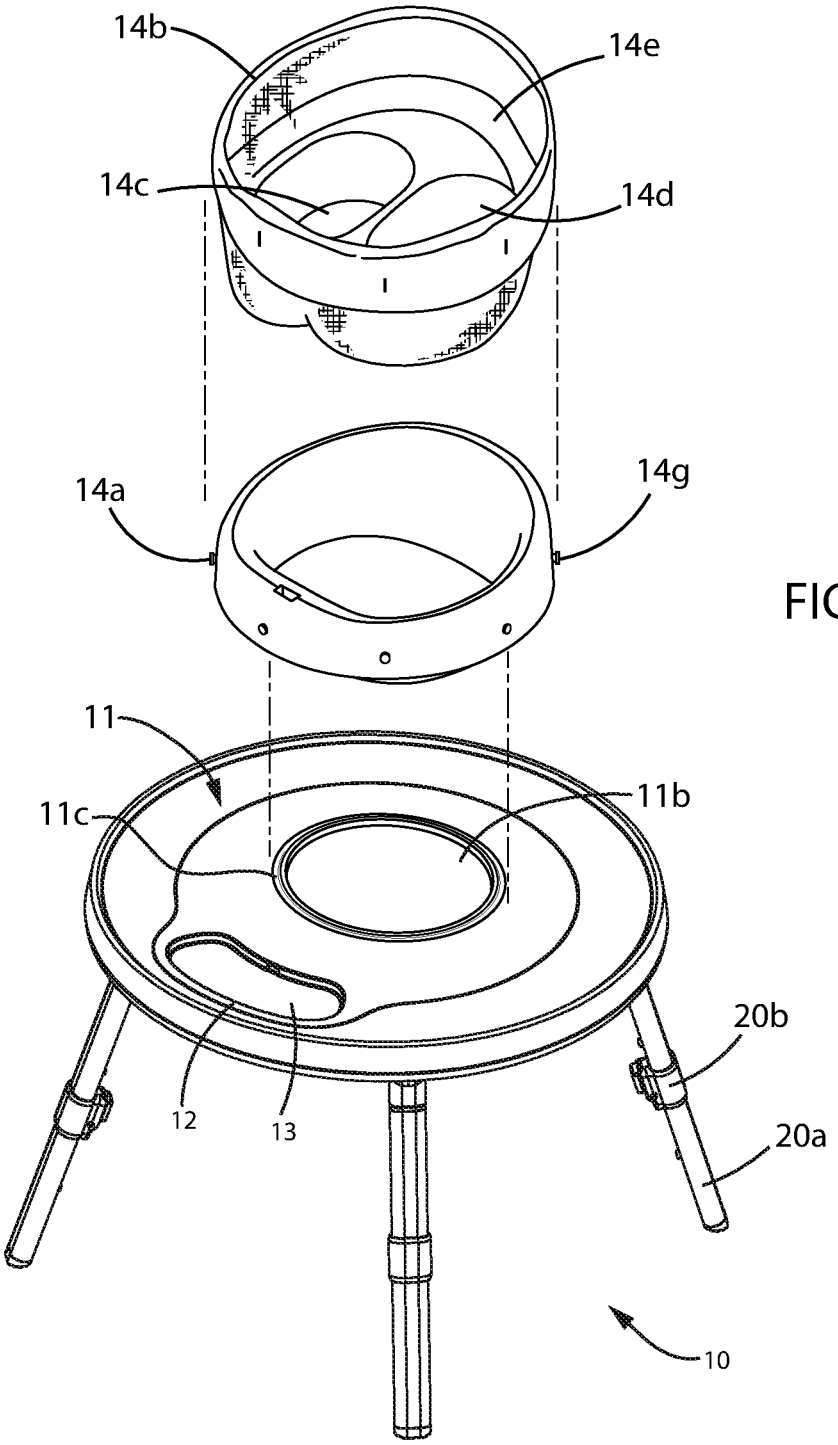
FIG. 2*d* shows an exploded view of the seat of the activity center and the play tabletop of the activity center in accordance with aspects of the present invention.

Referring to FIGS. 2*a* to 2*c*, an embodiment of the child seat 14 is illustrated Further, referring to FIG. 2*d*, an exploded view of one configuration of the child activity center 10 is illustrated. The seat 14 is comprised of a seat attachment ring 14*a* with a central seating opening 14*h* and a seating fabric 14*b*. The illustrated seating fabric 14*b* includes two leg holes 14*c* and 14*d* through which the legs of a child may be inserted. The seating fabric 14*b* may be comprised of any number of fabrics, either a single type of fabric or multiple types of fabric. For example, the illustrated seating fabric 14*b* includes a band of elastic material 14*e* that allows for a child seated in the seat 14 to use his or her weight and/or movement of his or her legs to slightly move in a vertical direction (e.g., by pushing his or her feet off of the bottom platform 30 when seated). Thus, the majority of the seat 14 may be comprised of a minimally stretching fabric (or fabric with a protective washable liner) and a portion may be comprised of a stretching material to allow the child greater freedom of movement.

As illustrated in FIG. 2*b*, the seating fabric 14*b* is attached to a rigid seat attachment ring 14*a*. The seating fabric 14*b* may include any number of fasteners and the attachment ring 14*a* includes complementary fastener components 14*g*. For example, as illustrated, attachment ring 14*a* includes protrusions as fastener components 14*g*, extending along the outer perimeter. The protrusions allow for holes that are sewn or otherwise disposed on the inner surface of the seating fabric 14*b* to secure to the attachment ring 14*a*. Advantageously, the seating fabric 14*b* is removably secured to the attachment ring 14*a* to allow for the seating fabric 14*b* to be removed for cleaning and/or storage. Other types of fasteners may be utilized, such as snaps, VELCRO, buttons, strings, and/or any other fasteners that allows for the seating fabric 14*b* to be secured to the attachment ring 14*a*. When attached, the seating fabric 14*b* wraps around the upper surface of the attachment ring 14*a* and hangs below the attachment ring 14*a* and through the central seating opening 14*h*, as illustrated in FIG. 2*d*.

In operation, the seat attachment ring 14*a* is situated on top of the tabletop 11 such that the seating fabric 14*b* hangs below the upper or top play surface 11*a* of the tabletop 11. The attachment ring 14*a* includes guide tabs 14*f* that allow for the attachment ring 14*a* to snap into place in the central opening 11*b* of the tabletop 11. For example, when snapped into place, the horizontal protrusion portion of each guide tab 14*f* is positioned below the tabletop 11 such that the attachment ring 14*a* is allowed to freely rotate while still fitting securely into the tabletop 11. To insert or remove the child seat 14, the guide tabs 14*f* and/or the tabletop 11 may be deformed slightly to allow the guide tabs 15*f* to fit through the central opening 11*b*.

A plurality of wheels 80 are attached to the lower surface of the attachment ring 14*a*. The wheels 80 include a spinning portion 80*a* and an axle 80*b*. The wheels 80 are attached by the axle 80*b* to the attachment ring 14*a* such that the outer surface of the spinning portions 80*a* are substantially parallel to the circumference of the attachment ring 14*a*. The wheels 80 are attached to the attachment ring 14*a* to allow for the spinning portion 80*a* and/or the entire wheels 80 to rotate freely while still being secured to the attachment ring 14*a*. For example, as illustrated, the axles 80*b* snap into slots 14*k* on the underside of the attachment ring 14*a*.

In operation, the wheels 80 rest on a track 11*c* of the tabletop 11. The wheels 80 are thus permitted to freely travel along the track 11*c*, keeping the child seat 14 from moving horizontally while still allowing the child seat 14 to freely swivel 360 degrees. In this manner, a child seated in the child seat 14 may turn to access any objects attached to or placed on the upper or top play surface 11*a* of the tabletop 11. In some embodiments, a lubricant may be applied to the wheels 80 and/or track 11*c* to allow for the child seat 14 to swivel with less effort by the child. Alternative components may be utilized to allow for the child seat 14 to swivel freely while restricting horizontal movement. For example, the attachment ring 14*a* may include ball bearings that are partially exposed to the track 11*c* when the child seat 14 is inserted into the central opening 11*b* of the tabletop 11.

As previously described, the elasticity of the stretching portion 14*e* of the child seating fabric 14*b* allows an infant to push downward with his or her feet on the bottom platform 30 when he or she is located in the seat 14 to bounce while sitting in the seat 14. Alternatively, an activity center seat may not be composed of elastic material but the child seat 14 may be operatively associated with the tabletop 11 and/or the attachment ring 14*a* using elastic material (e.g. straps, bungee cord, springs, and the like). Of course, still alternatively, both the child seat 14 and its association with the tabletop 11 can be via elastic straps, bungee, etc.

Referring again to FIG. 1, extending downward from the activity center 10 are four legs 20. In some embodiments, as few as three legs 20 may be included or any number of additional legs 20 may be included. A rigid bottom platform 30 is attached to each of the legs 20 using a respective strap 32. One end of each strap 32 is attached to the bottom platform 30 and an opposite end of each strap 32 is attached to a respective leg 20.

The legs 20 are adjustable so as to adjust the distance between the seat 14 and bottom platform 30 to accommodate different infants and to allow for adjustability as a baby grows. Each of the legs 20 is comprised of a leg portion 20*a* and an adjustable collar portion 20*b*. Each of the straps is attachable to the adjustable collar portion 20*b* of a leg. As illustrated each leg end of a strap 32 includes a tab and each of the adjustable collar portions 20*b* includes a receiver for the tab. The tabs then snap into the receivers and allow for the bottom platform 30 to be suspended above and parallel to a floor surface below the tabletop 11. Further, the adjustable collar portion 20*b* of each of the legs 20 is adjustable, allowing the adjustable collar portion 20*b* to slide further up or down the leg 20 (i.e., closer to the tabletop 11 or closer to the floor). For example, each of the leg portions 20*a* may include a plurality of receivers and each of the adjustable collars portions 20*b* may include a tab that is insertable into one of the receivers, thus allowing the adjustable collar portion 20*b* to remain in a place if desired while still allowing the location of the adjustable collar portion 20*b* to be changed as a child grows and requires more legroom between the seat 14 and the bottom platform 30.

In some embodiments, the straps 32 may be comprised of a non-elastic or minimally elastic material. In other embodiments, the straps 32 may be comprised of an elastic material to allow for movement of the bottom platform 30, such as a "trampoline-like" platform for the child to bounce vertically. Thus, the activity center 10 may include elastic in any one of the seat 14, the attachment of the seat 14 to the tabletop 11, and/or the straps 32.

Referring again to FIG. 1 and FIGS. 3 to 5, the button accessory 40 is in the form of a piano having a number of different individual keys 42, which may be uniformly or different colors, illuminate and/or play a sound when pressed. While depicted as having four keys, the button accessory 40 can have more than four or few than four keys. The button accessory 40 can be disposed and locked securely in place on either the tabletop 11 over window opening 12 (which may include a window 13) or in the bottom platform 30 in recess 34. The button accessory 40 can also be placed on the floor or a table when not used with the activity center 10.

Window opening 12 is of a sufficient size to allow a child seated in the seat 14 to see his or her feet and/or toys located below the tabletop 11 through the window opening 12. For example, a child sitting in the seat 14 can look through window opening 12 and see his or her feet and button accessory 40 located on the platform 30, disposed therebelow.

Figure 3A:
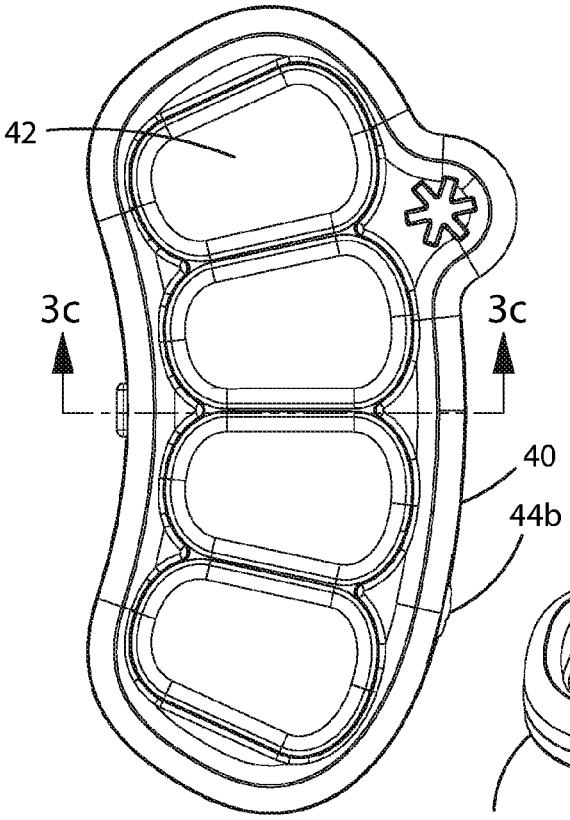
FIG. 3*a* shows an overhead view of a button accessory shaped like a piano that may be attached to the activity center in accordance with the present invention.
Figure 3B:
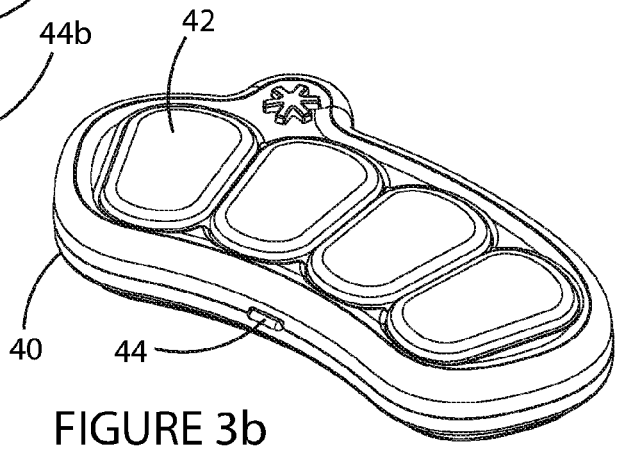
FIG. 3*b* shows a perspective view of the button accessory in accordance with the present invention.
Figure 3C:
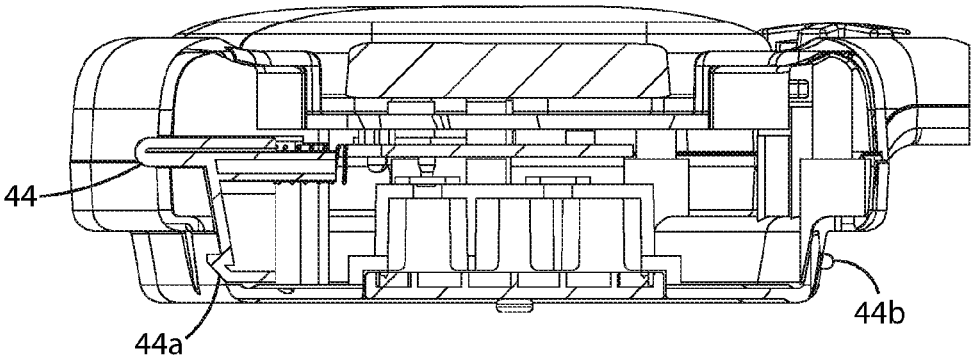
FIG. 3*c* shows a section view of the button accessory as view from the section line labeled "3c" in FIG. 3*a*.
Figure 4C:
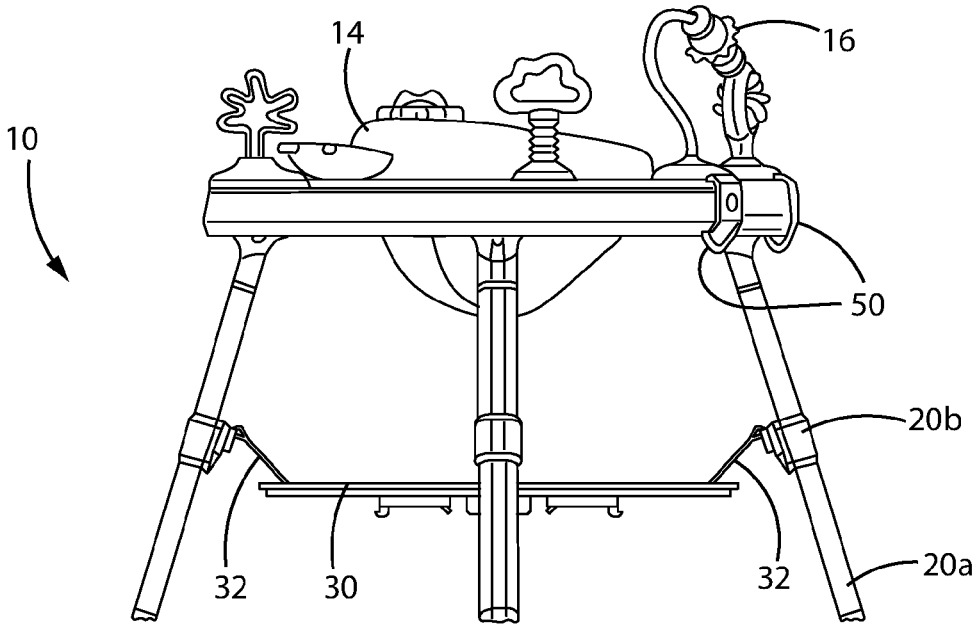
FIG. 4*c* shows a side view of the activity center with the button accessory located on the play tabletop in accordance with the present invention.
Figure 4D:
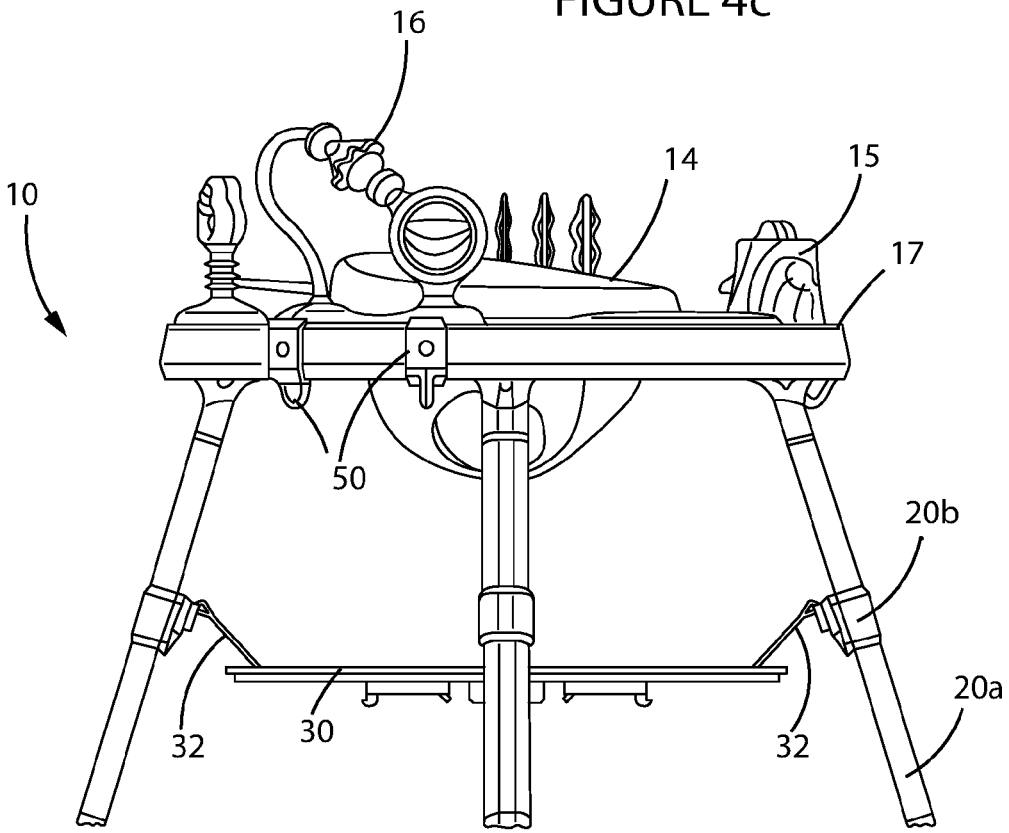
FIG. 4*d* shows another side view of the activity center with the button accessory located on the play tabletop in accordance with the present invention.
Figure 5A:
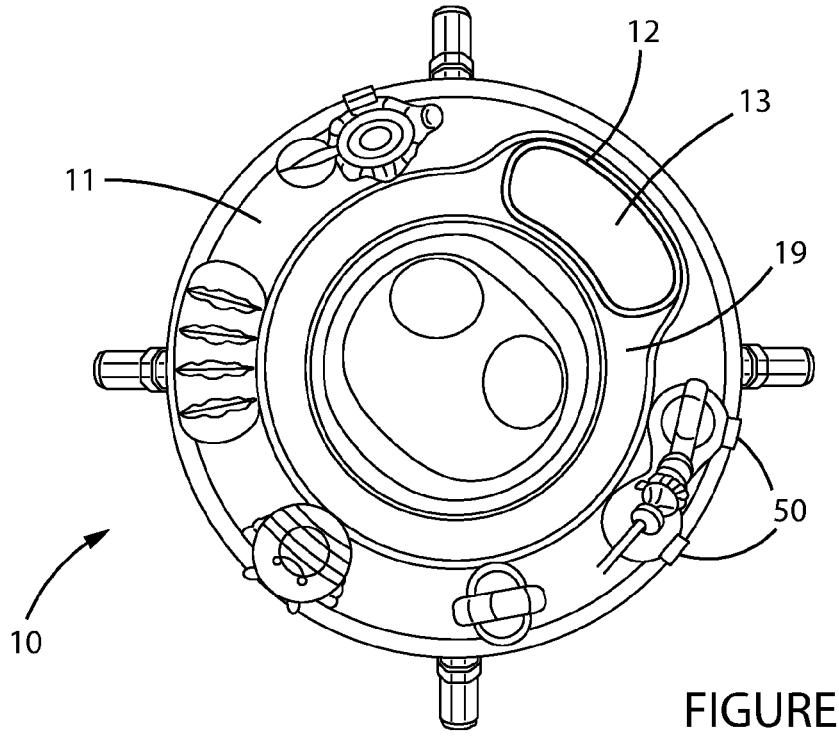
FIG. 5*a* shows an overhead view of the activity center with the button accessory located on the bottom platform in accordance with the present invention.
Figure 5B:
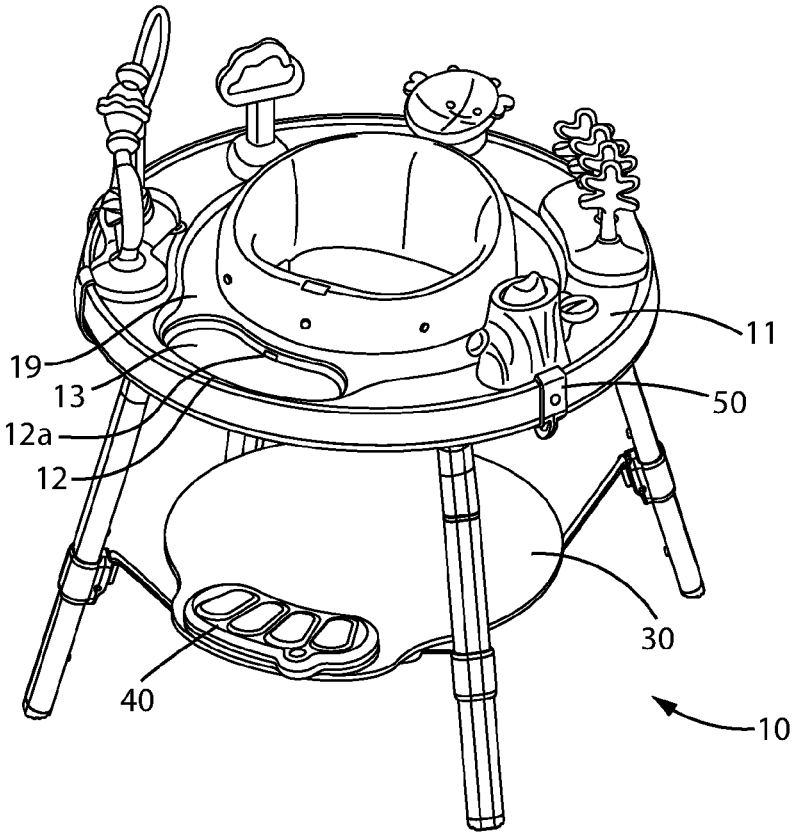
FIG. 5*b* shows a perspective view of the activity center with the button accessory located on the bottom platform in accordance with the present invention.
Figure 5C:
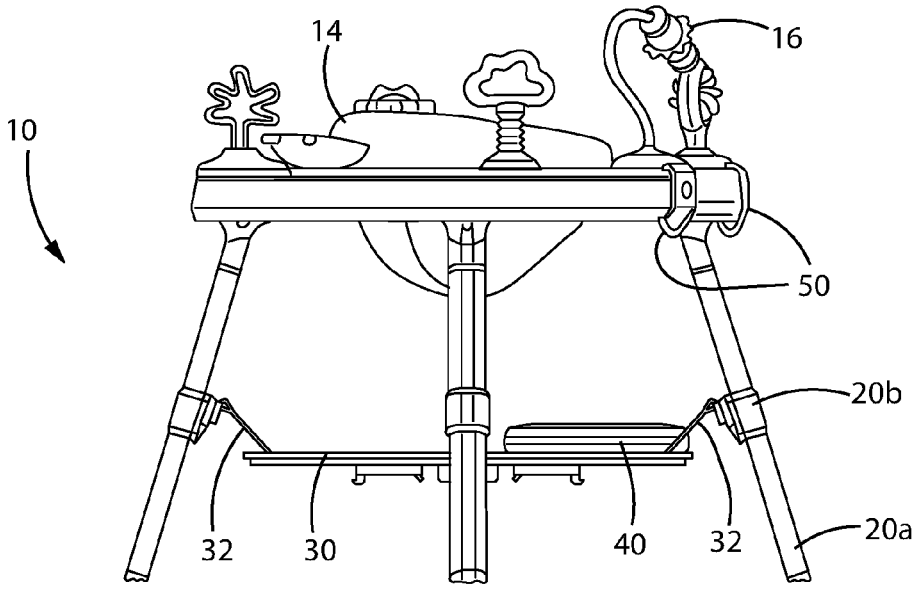
FIG. 5*c* shows a side view of the activity center with the button accessory located on the bottom platform in accordance with the present invention.
Figure 5D:
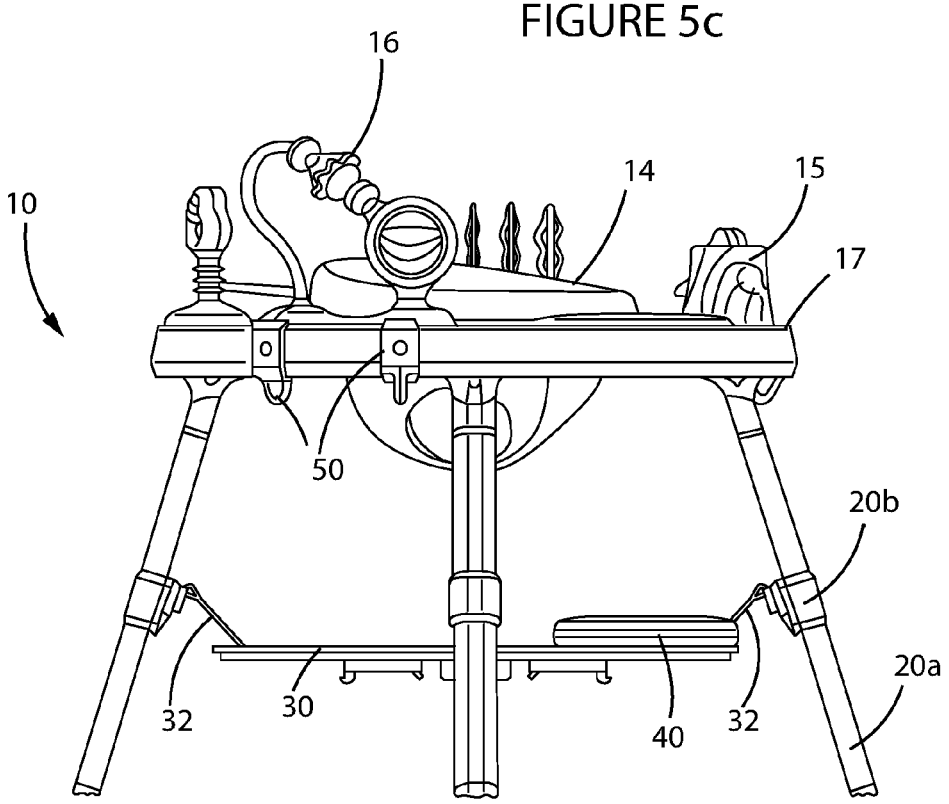
FIG. 5*d* shows another side view of the activity center with the button accessory located on the bottom platform in accordance with the present invention.
Figure 6A:
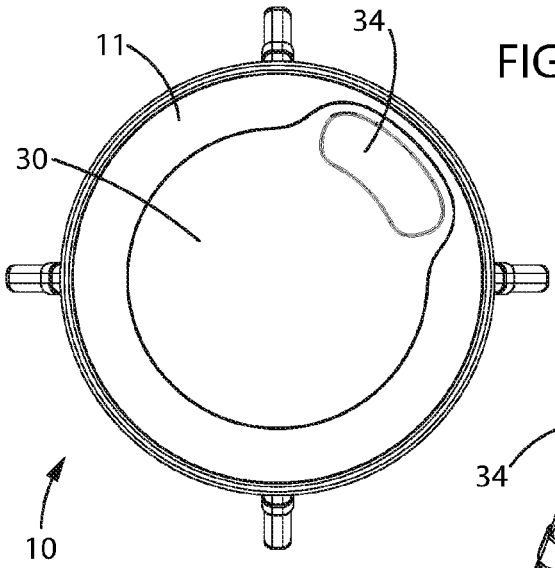
FIG. 6*a* shows a top view of an activity center in which the bottom platform has been placed on top of the top play surface forming a table in accordance with another aspect of the present invention.
Figure 6B:
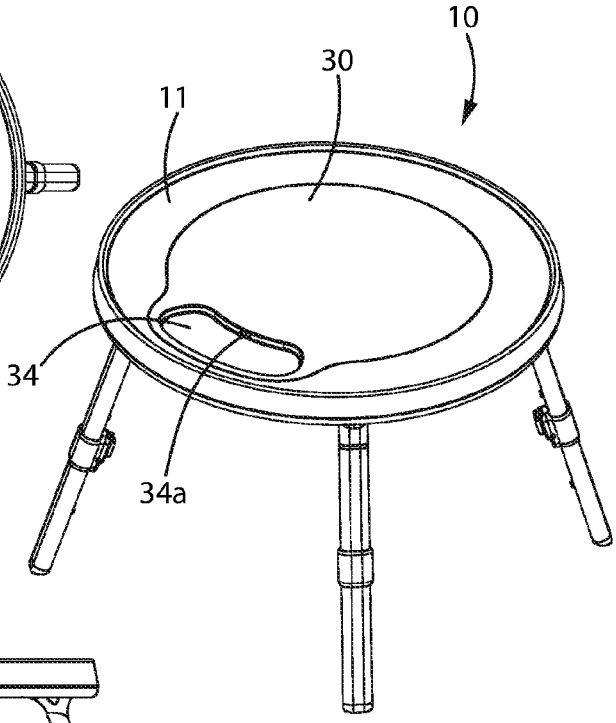
FIG. 6*b* shows a perspective view of an activity center in which the bottom platform has been placed on top of the top play surface forming a table in accordance with another aspect of the present invention.
Figure 6C:
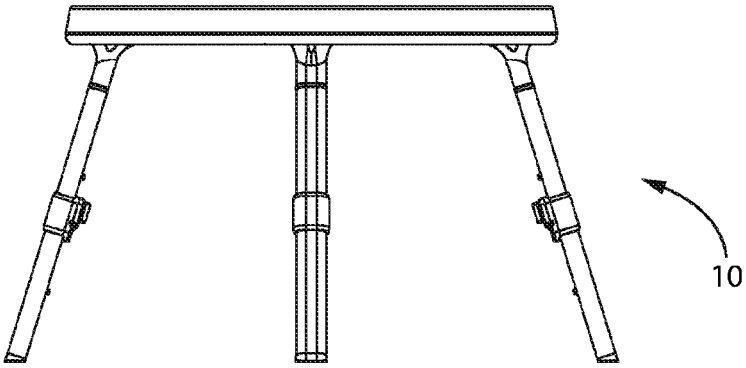
FIG. 6*c* shows a side view of an activity center in which the bottom platform has been placed on top of the top play surface forming a table in accordance with another aspect of the present invention.
Figure 6D:
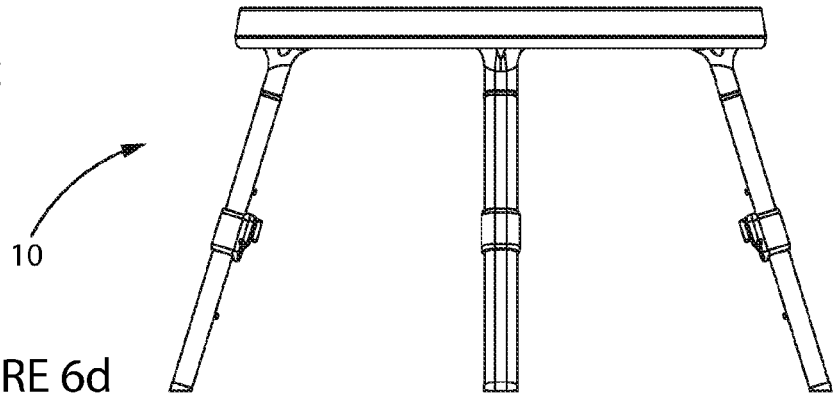
FIG. 6*d* shows another side view of an activity center in which the bottom platform has been placed on top of the top play surface forming a table in accordance with another aspect of the present invention.

Referring specifically to FIG. 3, the button accessory 40 has a button 44 that is connected to a tab 44*a* When the button 22 is pressed, the tab 44*a* moves in the same direction as the button 44 is pressed (i.e., horizontally and toward the opposite side of the button accessory 40). The button 44 and tab 44*a* may be positioned adjacent to a spring mechanism and, when pressure is no longer applied to the button 44, both the button and the tab 44*a* may return to their original location and orientation. The tab 44*a* is receivable by either notch 12*a* (when the button accessory 40 is attached to tabletop 11) or notch 34*a* (when the button accessory 40 is attached to the bottom platform 30). In operation, the button 44 may be pressed, moving the tab 44*a*, and the button accessory 40 may be placed in the recess 34 or over the window opening 12. Once in place, the button 44 may be released, thus allowing the tab 44*a* to engage in notch 34*a* or 12*a*, respectively. Once locked into place, the button accessory 40 is secured to the desired surface by both the tab 44*a* and by a rigid tab 44*b* on the button accessory 40, which is receivable by a second receiver located in both recess 34 and window opening 12 (not shown).

When the button accessory 40 is located on the bottom platform 30 and the child activity center 10 is configured as a seat, an infant can press the individual keys 42 with his or her feet to play its respective sounds and to be illuminated upon being depressed. Window 13, located in window opening 12 in the tabletop 11, allows an infant to see the button accessory 40 while sitting in the seat 14. Accordingly, this provides a developmental feature which helps babies associate the movement of their feet with their own bodies and outside effects. Further, as described herein, the button accessory 40 may be attached to the bottom platform 30 when the bottom platform 30 is attached to the tabletop 11 (as described below).

An absence of holes, recesses, depressions, lower portions, pockets, allows the present activity center 10 to be transformed between a play center to a table with a smooth surface. Other activity centers that are transformable from a seat to a table often include one or more holes or openings around the outer perimeter to provide for attachment of accessories. However, when such an activity center is configured as a table, the openings either remain or require an additional component to insert into the opening(s) to result in a flat table surface. In the present invention, the bottom platform 30 has a substantially planar surface, except for recess 34 so that when placed in recess 19 of the tabletop 11, a substantially planar surface for a table is achieved at the top of the activity center 10 without requiring additional components.

Figure 7A:
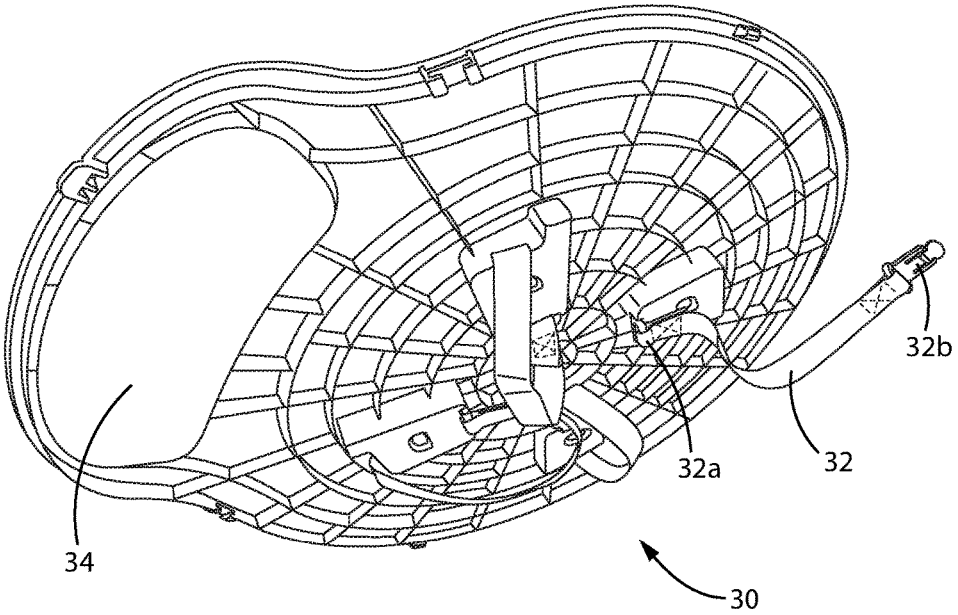
FIGS. 7*a* and 7*b* show perspective views of the bottom platform of the activity center in accordance with another aspect of the present invention.
Figure 7B:
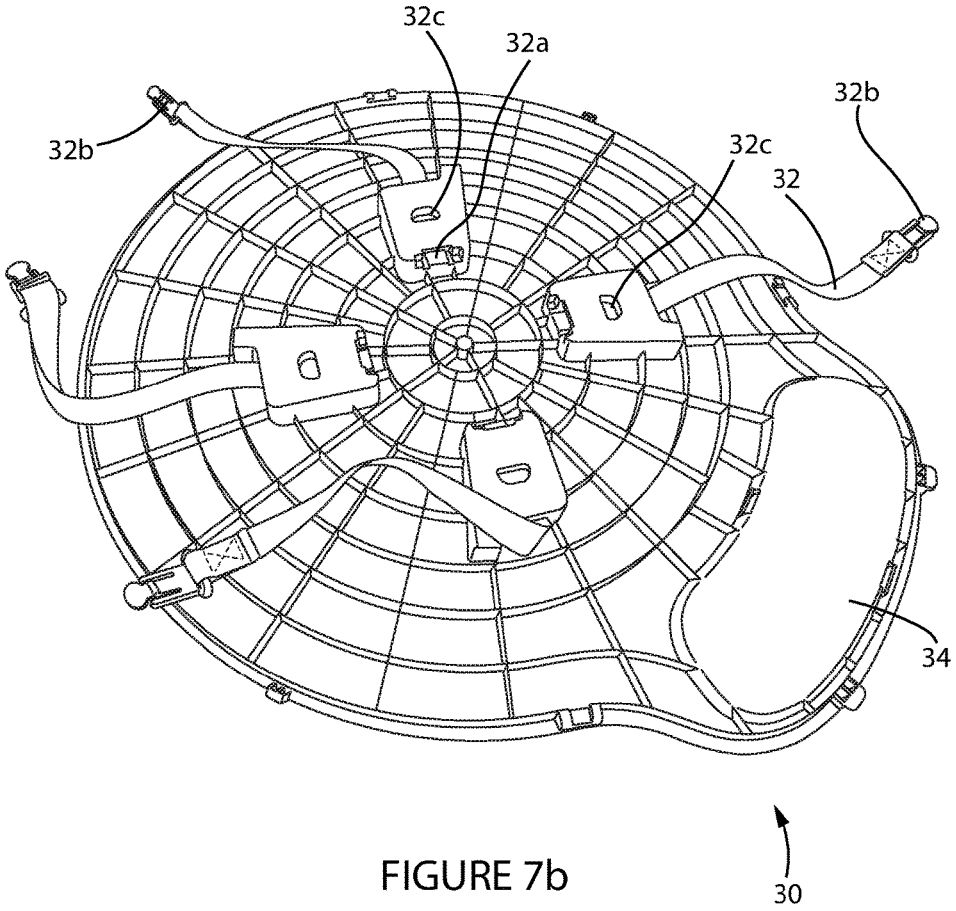
Figure 7C:
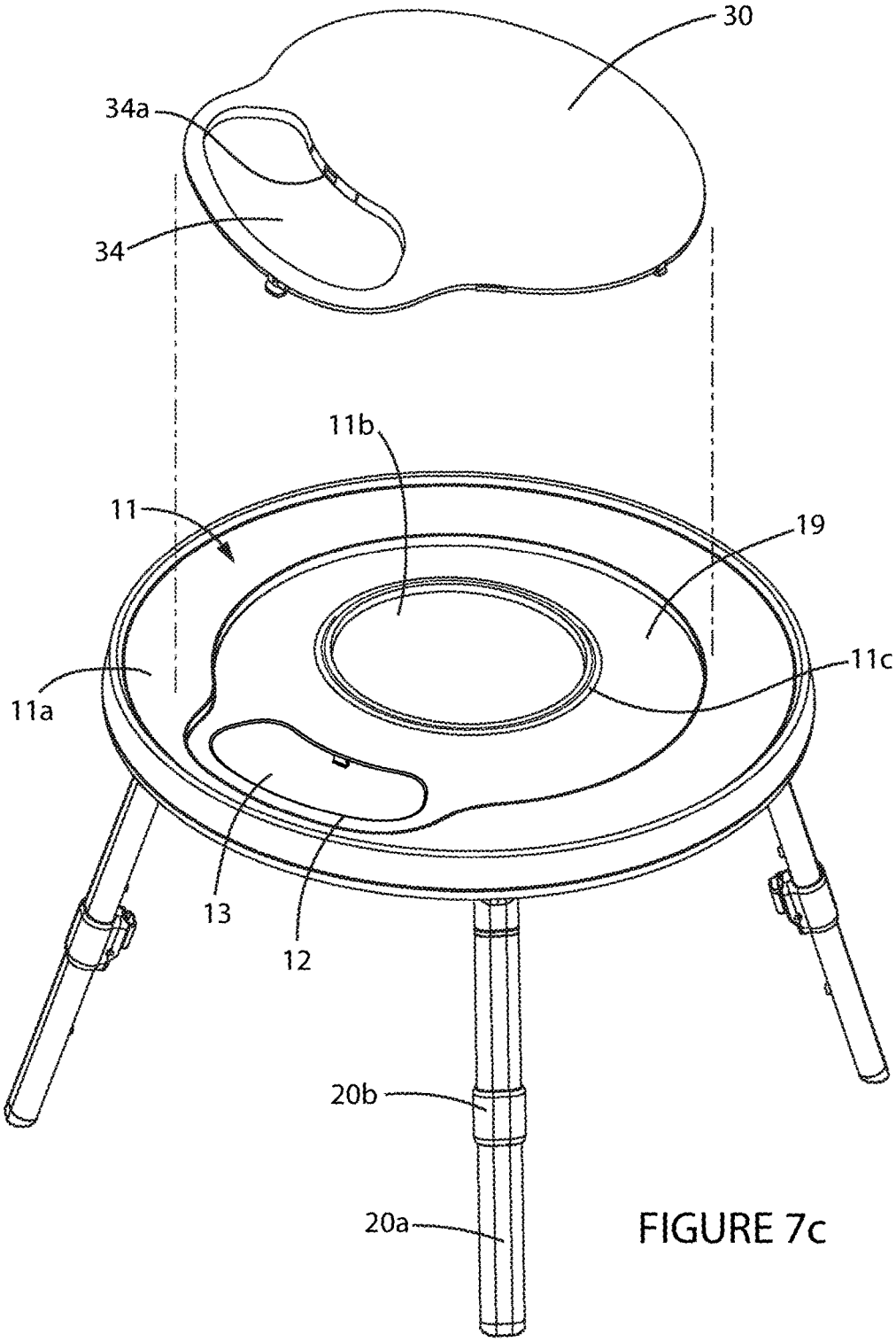
FIG. 7*c* shows an exploded view of the bottom platform attached to the play tabletop in accordance with another aspect of the present invention.

Referring to FIG. 6-7*c*, the bottom platform 30 has a same or similar dimension to recess 19 formed in the top play surface of tabletop 11. As shown in exploded view FIG. 7*c*, the bottom platform 30 can be placed on top of the tabletop 11 in the recess 19. When bottom platform 30 is attached to the tabletop 11 in this manner, the entire top surface of the tabletop 11 is substantially level and free of indentations, except for recess 34, which is located over window opening 12 and window 13. As previously described, button accessory 40 may be attached at recess 34 when the activity center 10 is in this configuration. Alternatively, the recess 34 may be utilized by a toddler to place objects, such as pencils or crayons, to temporarily store those items. Further, when the activity center 10 is in the table configuration illustrated in FIGS. 6 and 7*b*, the toys illustrated in other figures and described below, may be attached to the tabletop 11.

Straps 32 are attached to the underside of bottom platform 30 at platform end 32*a* and, when the activity center 10 is configured as a seat, the clips 32*b* on the straps are attached to the adjustable collar portion 20*b* of legs 20 as previously described. When the activity center 10 is configured as a table, the straps 32 are no longer required, so bottom platform 30 includes a second number of receivers 32*c* that are the same size and configuration as the receivers on the adjustable collar portions 20*b* of each of the legs 20. When the bottom platform 30 is attached to the tabletop 11, the straps 32 and receivers 32*c* are sized to fit within the central opening 11*b* of the tabletop 11. In this manner, the upper surface of bottom platform 30 will be positioned evenly with the tabletop 11 and all of the components on the underside of bottom platform 30 will rest below the surface of the tabletop 11.

Top play surfaces (11*a*) of activity centers, in accordance with the present disclosure, can have variations as shown, and may include others. For example, recess 34 may instead be an opening that may or may not include a window, similar to window opening 12. Further, the window 13 may be absent entirely and the window opening 12 may be entirely open.

Figure 8:
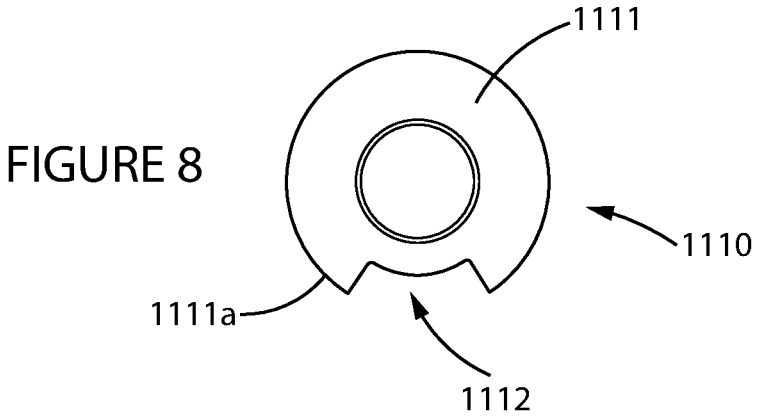
FIG. 8 shows another an alternative embodiment of an activity center having an alternative cut-out at a perimeter of a top play surface in accordance with another aspect of the present invention.
Figure 9:
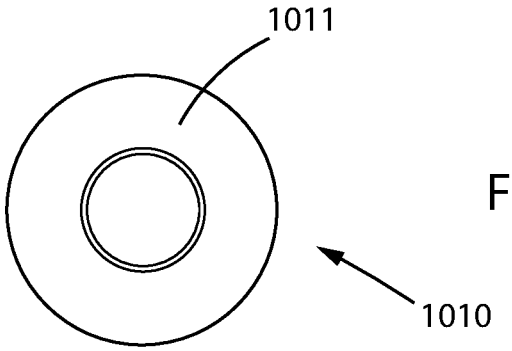
FIG. 9 shows another an alternative embodiment of an activity center having a clear or transparent top play surface in accordance with another aspect of the present invention.
Figure 10:
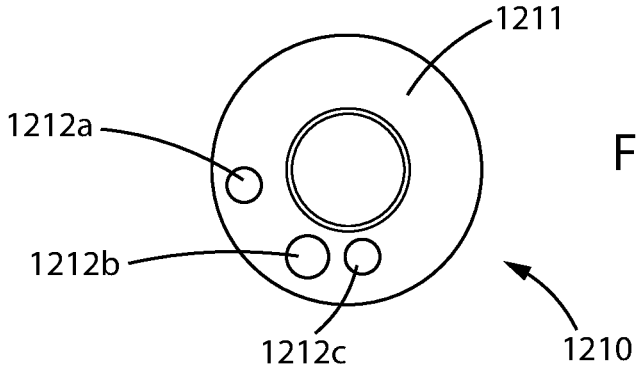
FIG. 10 shows yet another an alternative embodiment of an activity center having a series of cut-outs through a top play surface in accordance with another aspect of the present invention.
Figure 11A:
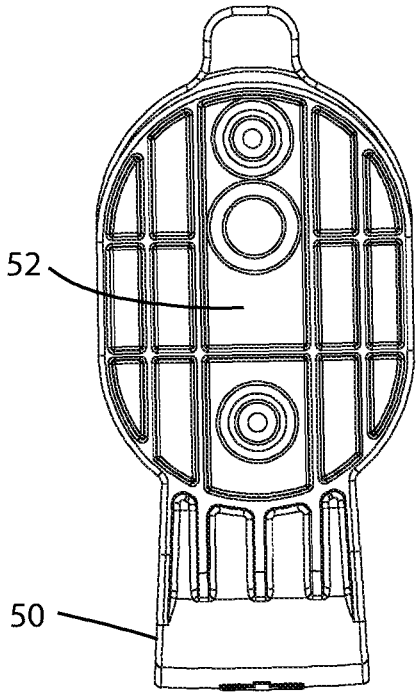
FIG. 11*a* shows a top view of a clip with suction cup in accordance with the present invention from different views.
Figure 11B:
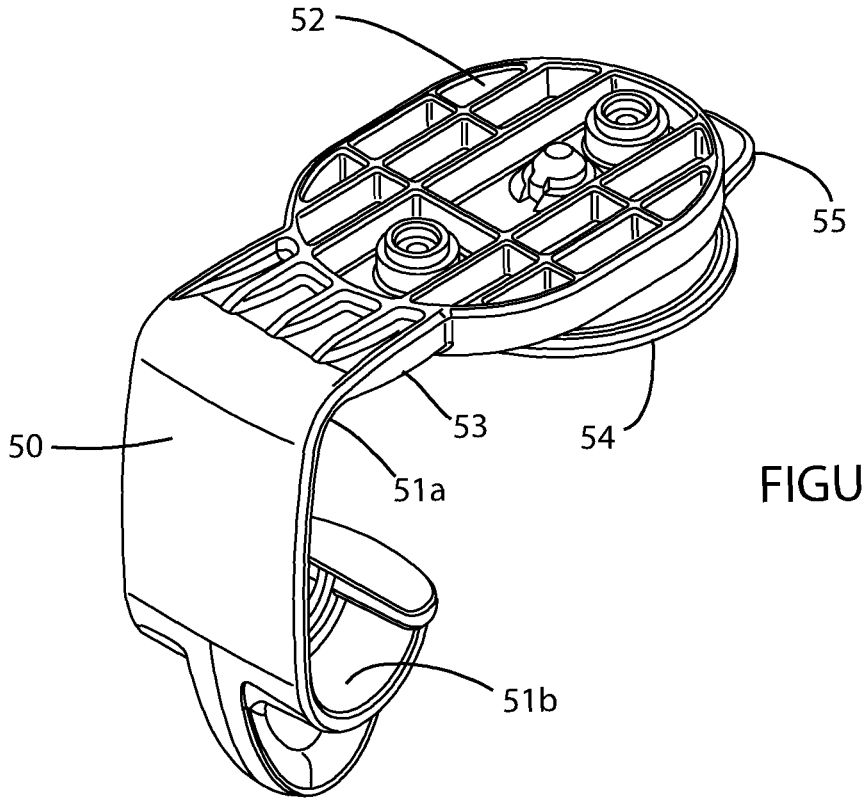
FIG. 11*b* shows a perspective view of the clip with suction cup in accordance with the present invention from different views.
Figure 11C:
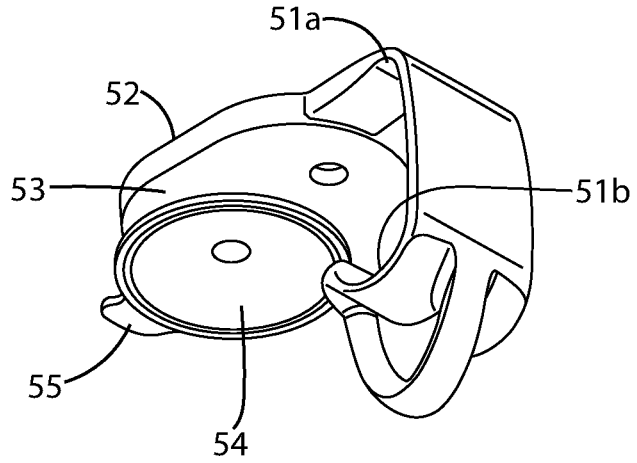
FIG. 11*c* shows another perspective view of the clip with suction cup in accordance with the present invention from different views.
Figure 11D:
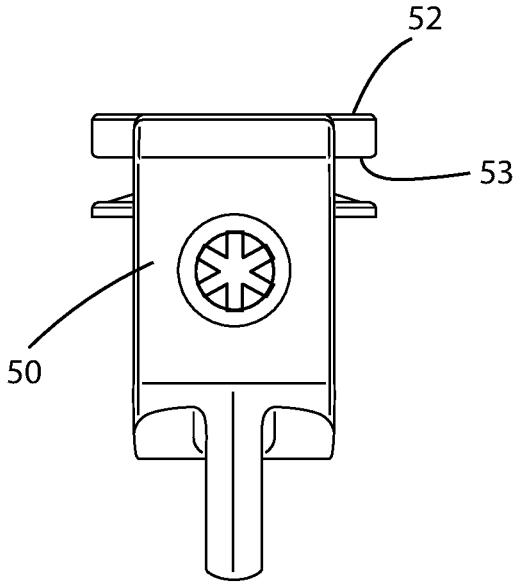
FIG. 11*d* shows a side view of the clip with suction cup in accordance with the present invention from different views.
Figure 11E:
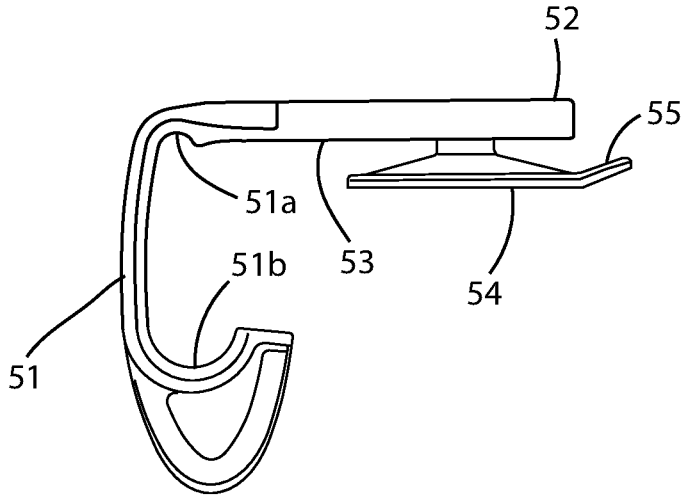
FIG. 11*e* shows another side view of the clip with suction cup in accordance with the present invention from different views.

Additional window configurations are shown in FIGS. 8-10. FIG. 8 shows yet another activity center 1110 having a tabletop 1111 with a cut-out section 1112 which allows one to see from the tabletop 1111 to objects below, e.g. items on a bottom platform such button accessory 40. The cut-out 1112 defining the opening in the play surface, extends cut-out from a remaining outer periphery edge 1111*a* of the table top, inward toward the center of the play top surface. Referring to FIG. 9, another alternative activity center 1010 is illustrated in which the entire tabletop surface 1011 is clear or transparent, acting itself as a window to see through the top surface 1011. Finally, FIG. 10 show still another alternative activity center 1210 having a tabletop 1211 with a series of openings 1212*a*, 1212*b*, 1212*c*. The openings can be unobstructed passages through the tabletop 1211, or have transparent windows, e.g. plastic, disposed in one or more or even all openings 1212*a*, 1212*b*, 1212*c*.

Referring again to FIG. 1 along with FIGS. 11*a*-11*e*, a number of toys 15, 16 (accessories) can be locked in place on the tabletop 11 using a bracket such as clip 50 (clip 50 best shown in FIGS. 11*a*-11*e*). Toys 15, 16 (accessories) are attached to an accessory end 52. The clip 50 is composed of a plastic or resilient material which allows the clip 50 to snap in place on a lip 17 (e.g. rim) of the tabletop 11. The clip 50 includes a bracket extension in the form of a C-portion 51 that acts as a hook to attach the clip 50 to the lip 17. The C-portion 51 has a top portion 51*a* which snaps in place over the upper lip 17*a* portion (see FIG. 1) of the tabletop 11 while the lower portion 51*b* snaps in place in an lower lip portion 17*b* (see again FIG. 1).

A suction cup 54 extends downwardly from a horizontal mounting surface 53 of the clip 50, in a direction opposite that of the accessory end 52. The suction cup 54 has a release tab 55.

Toys 15, 16 are secured to a top play surface of tabletop 11 by inserting lower portion 51*b* below the lower lip portion 17*b* and pressing the suction cup 54 onto the top play surface of the tabletop 11. The clip 50 allows toys 15, 16 to be securely placed on the tabletop 11 and positioned where a parent wishes them to be located on the tabletop 11.

Further, using clips 50 allows the tabletop 11 surface (e.g. around the perimeter outside of the recess 19) to be free of holes, recesses, depressions, lower portions, pockets, etc., where one would locate a toy to limit its movement on the surface. This provides a clean, flat, planar circumferential surface, around the perimeter of the tabletop 11. This allows for a substantially flat table when the activity center 10 is in the table configuration (except for the recess 34, as previously described).

It now will be clear that the present activity center has unique features and advantages not found in prior activity centers. Some of these features are identified in FIG. 1 and one or more, or even all, can be present in an activity center in accordance with the present disclosure. Accordingly, different combinations of features can be present based on what one wishes to have in an activity center.

We claim:

1. A child activity center, comprising:

a tabletop having a top play surface and a bottom surface opposite the top play surface, the tabletop defining a central opening and a window opening extending therethrough from the top play surface to the bottom surface of the tabletop;

a child seat removably disposed in the central opening;

a plurality of legs, each leg having a top end and a bottom end, wherein the top ends of each of the plurality of legs is attached to the tabletop;

a lower platform having a top surface, a bottom surface opposite the top surface, and an edge; and a plurality of straps each having a leg end and a platform end, wherein the leg end of each strap is attachable to one of the plurality of legs between the top end and the bottom end, and wherein the platform end of each of the straps is attachable to the lower platform, wherein the tabletop includes a recess, and wherein the lower platform is insertable into the recess.

2. The child activity center of claim 1, wherein the tabletop further includes a wheel track surrounding the central opening, and wherein the child seat comprises:

an attachment ring having an underside and an internal opening, and configured to removably attach on the top play surface over the central opening of the tabletop to allow the attachment ring to rotate 360 degrees;

a plurality of wheels attached to underside of the attachment ring, wherein the wheels are in contact with the wheel track when the attachment ring is attached to the tabletop; and a child seat fabric attached to the internal opening of the attachment ring and configured to receive a lower portion of a child when the attachment ring is attached to the tabletop.

3. The child activity center of claim 2, wherein the child seat fabric is at least partially comprised of an elastic material.

4. The child activity center of claim 3, wherein, when an infant is placed in the seat, the elastic material stretches and retracts in response to vertical movement of the child.

5. The child activity center of claim 1, wherein the child seat is attached to the tabletop by one or more elastic fabric components.

6. The child activity center of claim 1, wherein the leg ends of the plurality of straps are attachable to a plurality of locations on the legs.

7. The child activity center of claim 1, wherein the straps are comprised of an inelastic material.

8. The child activity center of claim 1, further comprising an interactive accessory removably attachable to the to play surface of the tabletop.

9. The child activity center of claim 8, wherein the interactive accessory is button accessory comprised of a plurality of buttons, each of the plurality of buttons, when activated, emitting a sound.

10. The child activity center of claim 1, wherein the window opening is covered by a transparent window.

11. The child activity center of claim 8, wherein the interactive accessory is attachable to the tabletop over the window opening.

12. The child activity center of claim 8, wherein the interactive accessory is attachable to the top surface of the lower platform.

13. The child activity center of claim 8, wherein the interactive accessory is attachable to a recess on the top surface of the lower platform.

14. The child activity center of claim 1, wherein the tabletop further comprises a lip, wherein the lip extends perpendicular to the top play surface and extends above the top play surface and below the bottom surface.

15. The child activity center of claim 14, further comprising: a removable accessory secured to the child activity center, comprising:

a bracket having a mounting surface and an underside;

a suction cup mounted on the underside of the bracket opposite the mounting surface; and a C-shaped hook attached perpendicular to the bracket;

wherein the suction cup adheres to the tabletop and the C-shaped hook surrounds the lip of the tabletop such that a top portion of the C-shaped hook mates with an interior facing surface of an upper portion of the lip extending above the top play surface and opposite a surface facing outwardly from the table top.

16. The child activity center of claim 1, wherein the tabletop includes a plurality of additional window openings extending therethrough.

17. A child activity center, comprising:

a tabletop having a top play surface, a bottom surface opposite the top play surface, and a rim on its outer perimeter, the rim being substantially perpendicular to the top play surface and extending below the bottom surface; and a removable tabletop accessory secured to the child activity center with a clip, the clip including an accessory end portion having a suction cup facing the play surface and being removably attached to the top play surface with the accessory attached to the accessory end portion facing away from the play surface, and a bracket extending downward from the accessory end portion and terminating in a lower portion made of a resilient materials which allows the lower portion to snap onto the rim of the tabletop, allowing secure placement of the accessory to the top play surface without through holes in the top play surface.

18. The child activity center of claim 17, wherein the accessory is a toy attached to the accessory end portion of the removable tabletop accessory.

19. The child activity center of claim 17, wherein the bracket has a C-shaped hook which engages the rim of the tabletop.

20. The child activity center of claim 17, wherein the tabletop is comprised of a rim play area devoid of openings and indentations.

21. A child activity center, comprising:

a tabletop having a top play surface and a bottom surface opposite the top play surface, the tabletop defining a central opening and a window opening in front of the central opening with the top play surface defining a recess that surrounds and is spaced apart from both the central opening and the window opening;

a child seat configured to be disposed in the central opening of the tabletop;

at least one toy having a foot print substantially the same size as the window opening allowing the at least one toy to be removably disposed within the window opening to prevent the at least one toy from sliding; and a moveable platform configured to be disposed below the tabletop in a first configuration and positioned within the recess of the top play surface of the tabletop in a second configuration;

wherein, when the platform is in the second configuration, the platform covers the central opening and the window opening of the tabletop, wherein, the window opening is of a sufficient size such that, when the at least one toy is not disposed within the window opening, a child seated in the seat can see his or her feet and/or toys located below the tabletop through the window opening.

22. The activity center of claim 21, further comprising a transparent member in the window opening.

23. The activity center of claim 21, wherein the tabletop has at least one second window opening of sufficient size so that a child, placed in the seat can see his or her feet and/or toys located below the tabletop through the at least one second window opening.

24. The activity center of claim 21, wherein, the at least one toy is also configured for removable attachment to the platform such that, when the platform is in the first configuration with the at least one toy attached to the platform, a child placed in the seat can see the at least one toy through the window opening.

25. The activity center of claim 24, wherein the at least one toy is an interactive toy which responds to actions of a child placed in the seat.

26. The activity center of claim 25, where the platform has a recess with a footprint dimension substantially the same as the window opening allowing the toy to be selectively placed within the recess of the platform, preventing the toy from sliding on the platform.

27. The activity center of claim 21, wherein the window opening is elongated circumferentially around the tabletop.

28. The activity center of claim 1, wherein when the lower platform is inserted into the recess, the lower platform and the tabletop form a substantially flat surface.

29. A child activity center, comprising:

a tabletop having a top play surface and a bottom surface opposite the top play surface, the tabletop defining a central opening and a window opening extending therethrough from the top play surface to the bottom surface of the tabletop, the tabletop having a lip, wherein the lip extends perpendicular to the top play surface and extends above the top play surface and below the bottom surface;

a child seat removably disposed in the central opening;

a plurality of legs, each leg having a top end and a bottom end, wherein the top ends of each of the plurality of legs is attached to the tabletop;

a lower platform having a top surface, a bottom surface opposite the top surface, and an edge;

a plurality of straps each having a leg end and a platform end, wherein the leg end of each strap is attachable to one of the plurality of legs between the top end and the bottom end, and wherein the platform end of each of the straps is attachable to the lower platform; and a removable accessory secured to the child activity center, comprising:

a bracket having a mounting surface and an underside;

a suction cup mounted on the underside of the bracket opposite the mounting surface; and a C-shaped hook attached perpendicular to the bracket;

wherein the suction cup adheres to the tabletop and the C-shaped hook surrounds the lip of the tabletop such that a top portion of the C-shaped hook mates with an interior facing surface of an upper portion of the lip extending above the top play surface and opposite a surface facing outwardly from the table top.

* * * * *